United States Patent [19]

Folger

[11] Patent Number: 4,628,636

[45] Date of Patent: Dec. 16, 1986

[54] GARAGE DOOR OPERATOR MECHANISM

[75] Inventor: Roger J. Folger, Whittier, Calif.

[73] Assignee: Holmes-Hally Industries, Inc., Los Angeles, Calif.

[21] Appl. No.: 611,725

[22] Filed: May 18, 1984

[51] Int. Cl.[4] ..... E05F 15/00

[52] U.S. Cl. ..... 49/199; 49/28; 49/139; 49/362

[58] Field of Search ..... 49/199, 200, 139, 362, 49/28; 160/188, 189

[56] References Cited

U.S. PATENT DOCUMENTS

| | | | |
|---|---|---|---|
| 2,589,480 | 3/1952 | Curtis | 49/139 X |
| 2,751,219 | 6/1956 | Dodge | 49/199 X |
| 3,435,558 | 4/1969 | Kruse | 49/200 |
| 3,526,994 | 9/1970 | Delaney | 49/199 |
| 3,608,612 | 9/1971 | Pemberton | 49/199 X |
| 3,625,328 | 12/1971 | Carli | 49/28 X |
| 3,996,697 | 12/1976 | Bailey et al. | 49/139 X |
| 4,107,877 | 8/1978 | Lee | 49/139 X |
| 4,131,830 | 12/1978 | Lee et al. | 49/199 X |
| 4,147,073 | 4/1979 | Mercier | 49/139 |
| 4,274,227 | 6/1981 | Toenjes | 49/199 |

*Primary Examiner*—Philip C. Kannan

*Attorney, Agent, or Firm*—Beehler, Pavitt, Siegemund, Jagger, Martella & Dawes

[57] ABSTRACT

An automatic radio actuated mechanism for opening and closing panels, such as a garage door, makes use of an electric motor to rotate a specially constructed spiral drive screw and move a traveler along a track, the traveler being connected to the door to pull the door open or push the door shut. Included in the mechanism is a camming arrangement for precisely adjusting the full open and full closed positions by action of an electronic circuit which activates the motor. For reversing the operating direction of door movement in the event such movement should be obstructed, the motor housing is mounted in a manner allowing it when restrained to swing for a limited distance, one way or the other, thereby to actuate a switch in the electronic circuit for reversing movement of the door.

37 Claims, 18 Drawing Figures

Fig. 7.
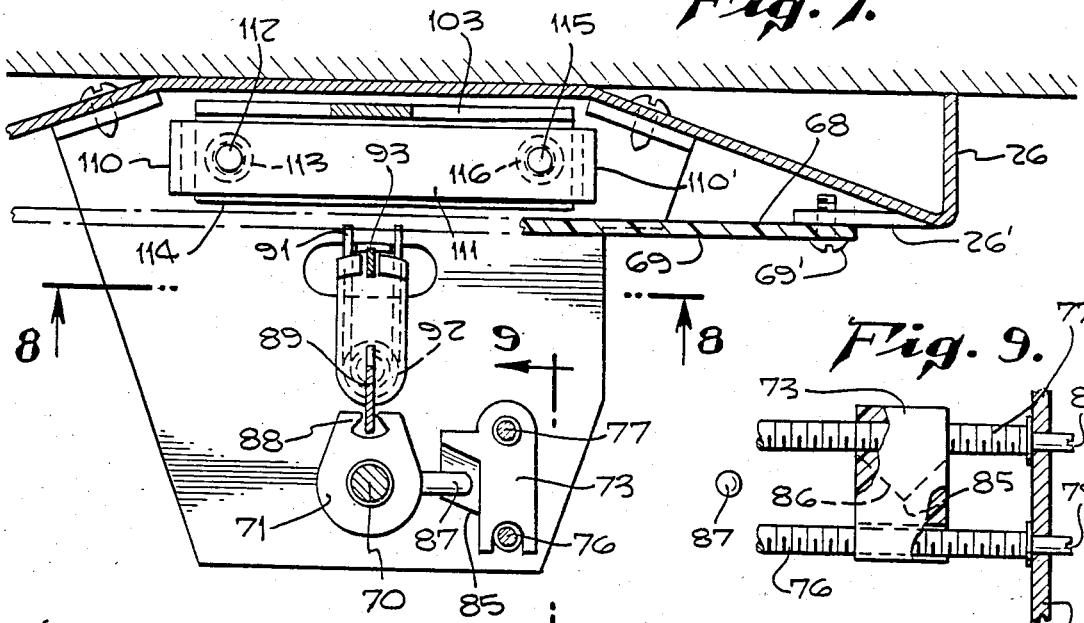
Fig. 9.
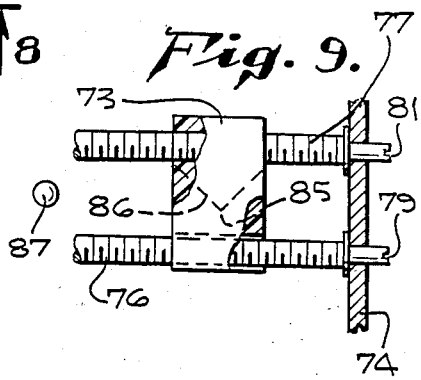
Fig. 10.
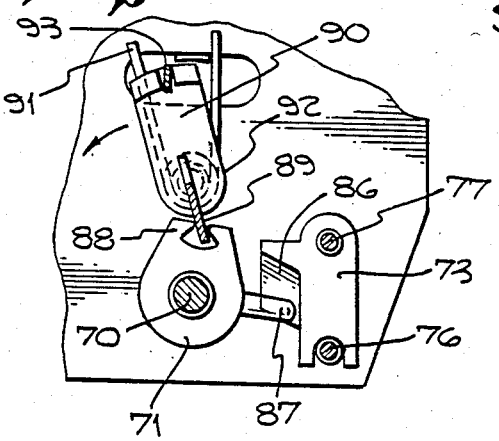
Fig. 11.
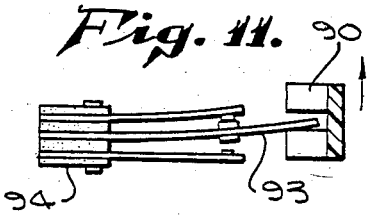
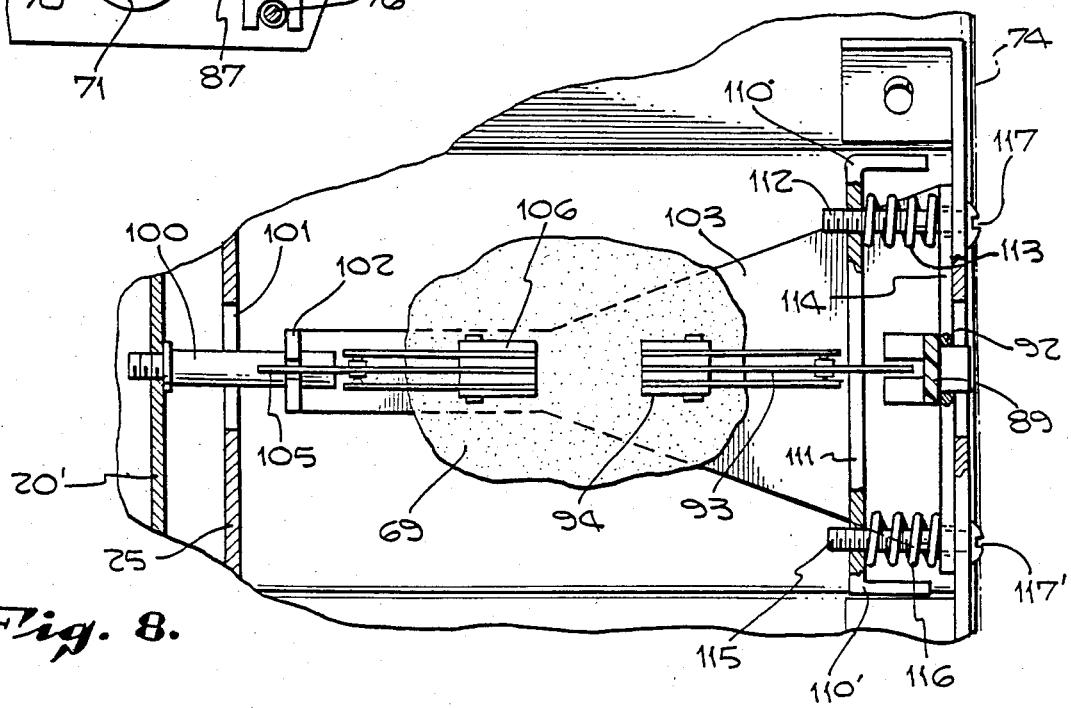
Fig. 8.

GARAGE DOOR OPERATOR MECHANISM

Remote radio controlled garage door openers, to which this invention relates, have been available and in use for a decade or more. In its simplest form, such a remote controlled garage door opener features a receiving set coupled to a motor actuated winch which is activated by a transmitter carried in the vehicle. When the vehicle approaches a closed door, a button on the transmitter is pressed, enabling the sending of a radio signal from the transmitter to the receiver. The receiver then, through an electronic circuit, amplifies the signal, setting in motion an electric motor. The motor, being attached to a garage door, which is normally counterbalanced with springs for ease in opening, operates through a linkage to pull usually upon the upper edge of the door, the linkage then moving through a range of travel sufficient to pull the door to open position. After the vehicle is driven into the garage through an open door, the transmitter is again triggered by the same button, causing it to send out another signal to the receiver, this time causing the electric motor to operate in reverse direction to close the door. There are a great many remote controlled radio operated automatic door openers on the market which operate on this broad general principle.

In additional to the broad functional attributes, various refinements have been worked into such mechanisms as, for example, a manual release capable of disengaging the automatic opening mechanism so that the door can be closed and opened by hand. Such a refinement is and has been an important one for occasions such as power failure or mechanical failure of some sort or other in the mechanism itself. In such event it is important to be able to open the door so that a person cannot be trapped inside or, on the other hand, prevented from driving a motor vehicle into the garage.

Another refinement subsequently worked into the broad general principle has been one capable of braki ng either closing or opening movement of the door in the event of striking an obstruction. For the most part, auxiliary refinements of this kind have been employed to stop further motion of the door, rather than causing the motion to reverse itself.

In today's climate of electronic controls, almost any combination of movements in a moving object may be possible by automatic remote radio control, provided enough components are employed in the electronic circuit, however complex it might be. One drawback in such an approach is the building of a relatively complex electronic structure which may be of unnecessarily high cost or, on the other hand, so complex as to cause appreciable servicing requirements. The more complex such a mechanism becomes, the heavier and more bulky it becomes, and also the more costly. Where devices are to be regularly operated by the average individual, unacquainted with the servicing of complex devices, it is highly advantageous to make use of the combined factors in an arrangement as simple as can be achieved, and also as rugged as may be practicable, so as to minimize calls upon servicing personnel, as well as frustration on the part of the user.

It is therefore among the objects of the invention to provide a new and improved remote radio controlled moving mechanism for panels such as a garage door which employs a relatively simple combination of mechanical and electronic expedients which embody a device incorporating not only the broad basic functions but most of the auxiliary refinements needed for both safety and convenience.

Another object of the invention is to provide a new and improved remote radio controlled moving mechanism such as a device for opening and closing a garage door wherein mechanical features are simplified to provide a lighter weight, less costly combination but which at the same time has the rugged dependability of more conventionally constructed mechanisms.

Still another object of the invention is to provide a new and improved radio remote controlled moving mechanism for a function such as the opening and closing of a garage door incorporating not only a manual release in case of electric failure but in fact a reciprocating release of such character that the automatic features can be promptly and easily re-engaged by manual means.

Still another object of the invention is to provide a new and improved remote controlled door opener mechanism featuring an adjustment for full closed and full open position wherein the adjustment is simple to make and readily accessible from the exterior.

Still another object of the invention is to provide a new and improved remote controlled automatic door opener of a character such that movement of the door toward either opening or closing positions cannot only be halted in the event that the door movement should be restrained as by striking an object, but can in fact reverse its operation.

Still another object of the invention is to provide a new and improved remote controlled door moving mechanism incorporating a tension adjustment readily accessible from the exterior which is capable of increasing or decreasing the sensitivity of the mechanism to reverse operation in either direction in the event of encountering an obstruction, the sensitivity being variable independently of respective upward or downward movement of the door.

Further included among the objects of the invention is to provide a new and improved remote controlled mechanism for opening and closing a door wherein a substantial number of the structural parts can be readily made of sheet metal stampings to greatly minimize the initial cost and at the same time provide an assembly which can be readily serviced.

Still further included among the objects of the invention is to provide a new and improved remote controlled garage door opening and closing mechanism wherein the panel on which the electronic circuit and components are mounted is of a construction and arrangement such that it can be located close to the mechanical or electrical operating parts subject to electronic control, thereby to simplify not only initial assembly but also subsequent servicing.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

FIG. 7 is a cross-sectional view on the line 7—7 of FIG. 2.

FIG. 8 is a fragmentary sectional view on the line 8—8 of FIG. 7.

FIG. 9 is a fragmentary vertical sectional view on the line 9—9 of FIG. 7.

FIG. 10 is a fragmentary sectional view similar to FIG. 7 but in a slightly different camming position.

FIG. 11 is a fragmentary plan view of the switch component subject to cam action.

There being various features of the combination having individual significance, the broad functional features of structure will be first made reference to, after which each of the features having special characteristics will be treated individually so that such special characteristics will not be overlooked. In following through on this plan reference will be initially made to the open spiral drive screw with its jacket and position in the track, as seen chiefly in FIGS. 2, 3, 4 and 5. This portion of the specification as it incorporates the self-lubricating traveler and its connection with the drive screw, is noted expressly in FIG. 4.

Figure 4:
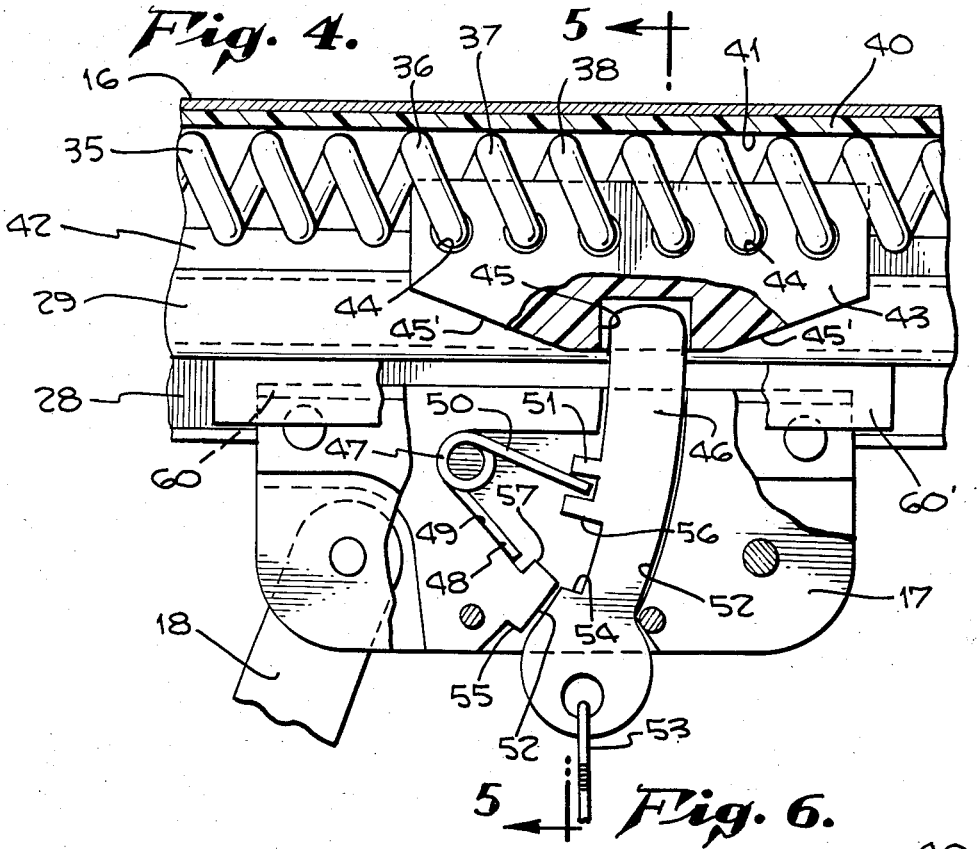
FIG. 4 is a fragmentary longitudinal sectional view of the panel drive block and its attachment to the drive screw.
Figure 5:
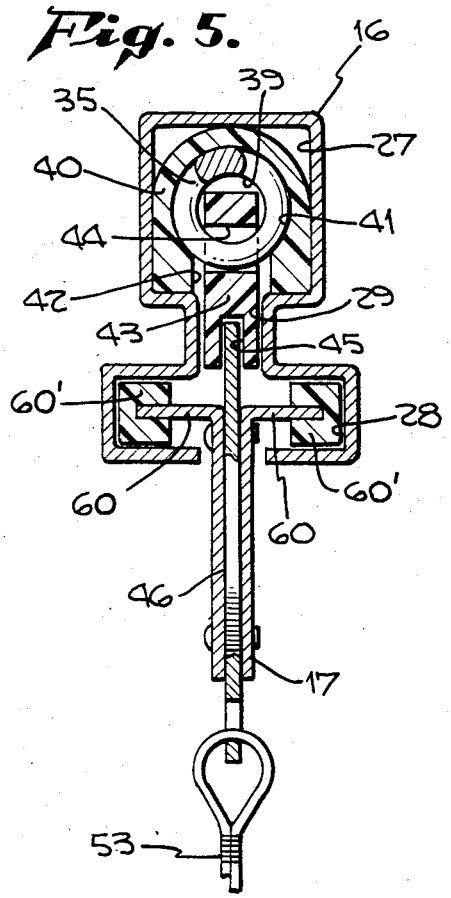
FIG. 5 is a cross-sectional view on the line 5—5 of FIG. 4.
Figure 6:
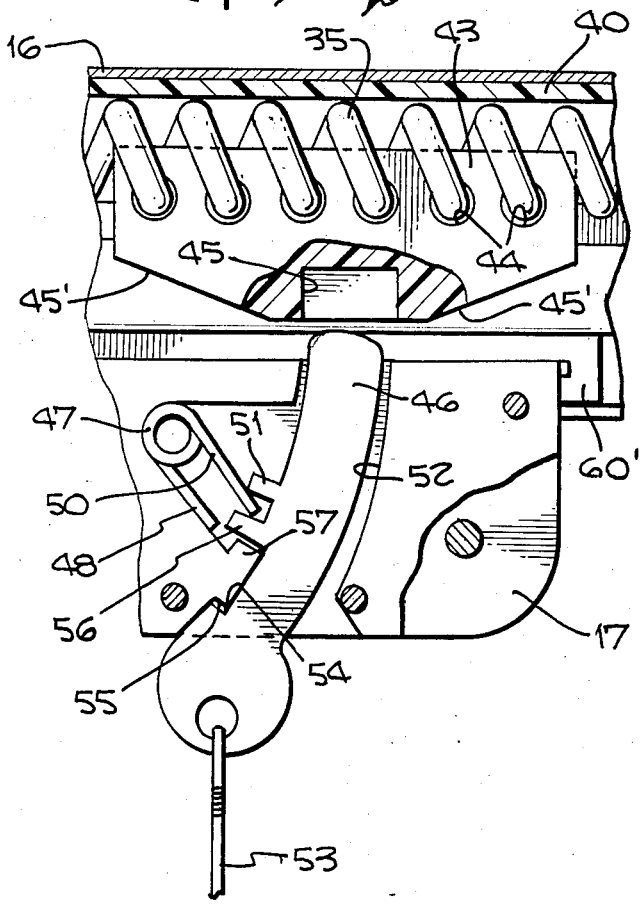
FIG. 6 is a fragmentary sectional view similar to FIG. 4 but showing the panel drive block disconnected from the drive screw components.
Figure 12:
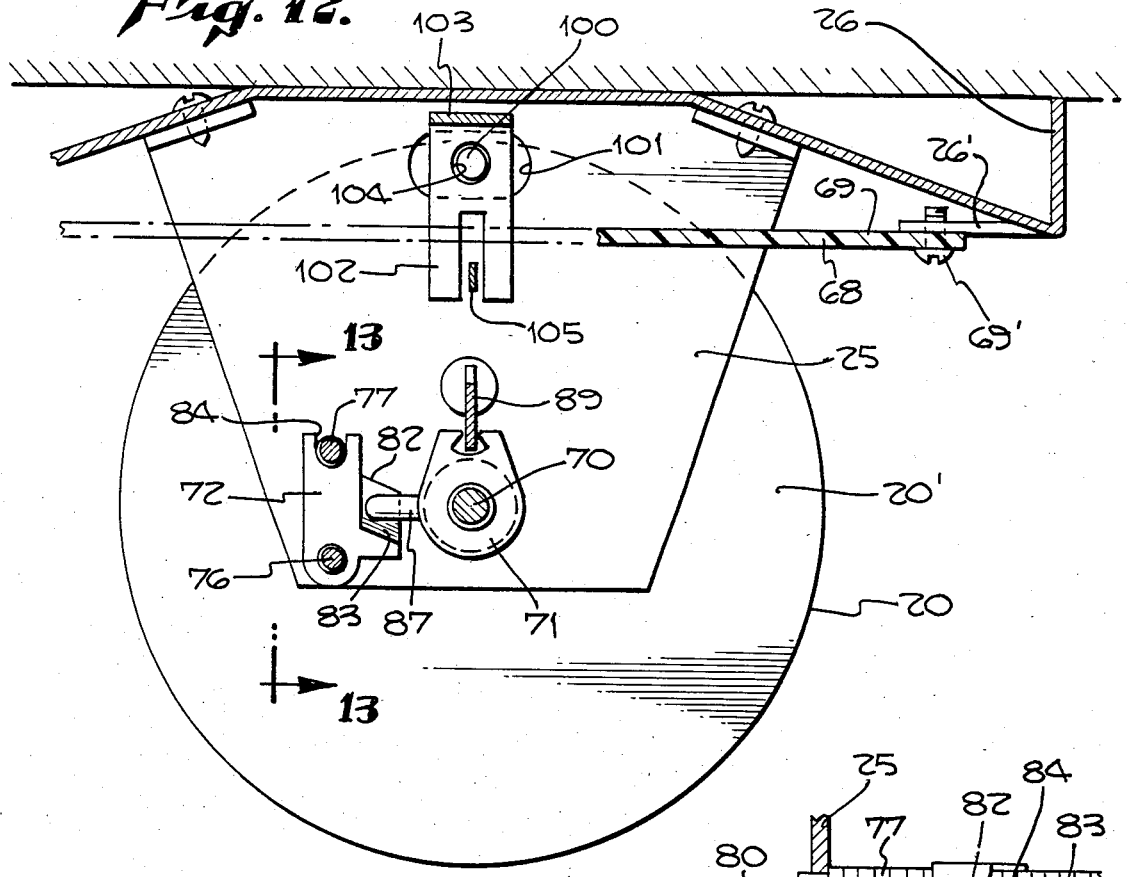
FIG. 12 is a cross-sectional view on the line 12—12 of FIG. 2.
Figure 13:
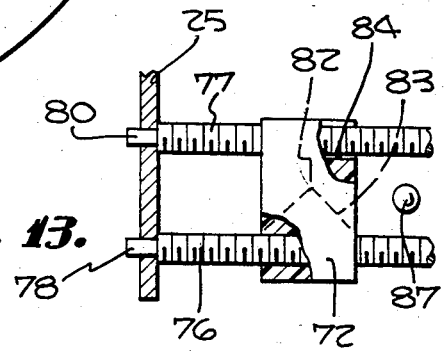
FIG. 13 is a fragmentary sectional view on the line 13—13 of FIG. 12.

The manual release and manual reconnect of the panel drive slot with a traveler attached to the drive screw will be treated as one of the combined units of particular individuality, as note FIGS. 4, 5 and 6.

Because the cam action and its various parts operate individually to adjust the mechanism at both the full closed and full open position, this feature will be treated individually by reference to FIGS. 7 through 13, inclusive.

Figure 14:
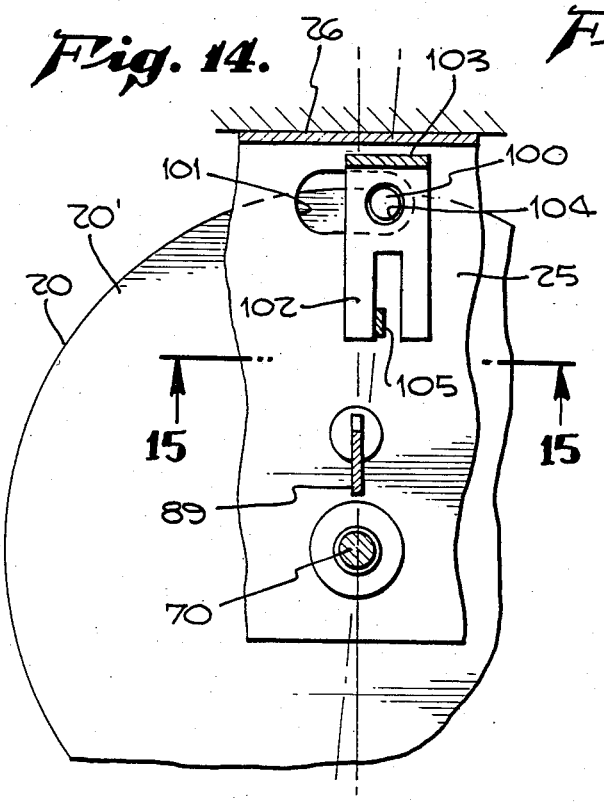
FIG. 14 is a fragmentary sectional view of parts of FIG. 12 but in a slightly different position of operation.
Figure 15:
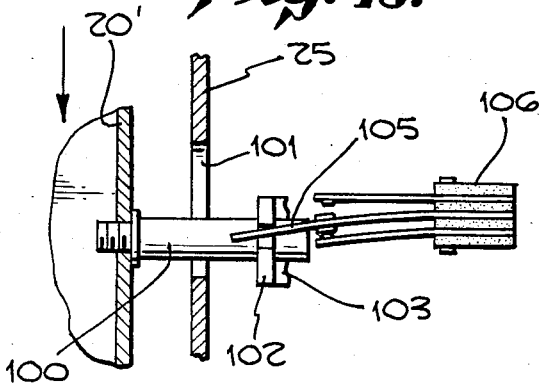
FIG. 15 is a plan view of the switch component operated by a shift in the position of the motor when the panel might strike an obstruction, on the line 15—15 of FIG. 14.
Figure 16:
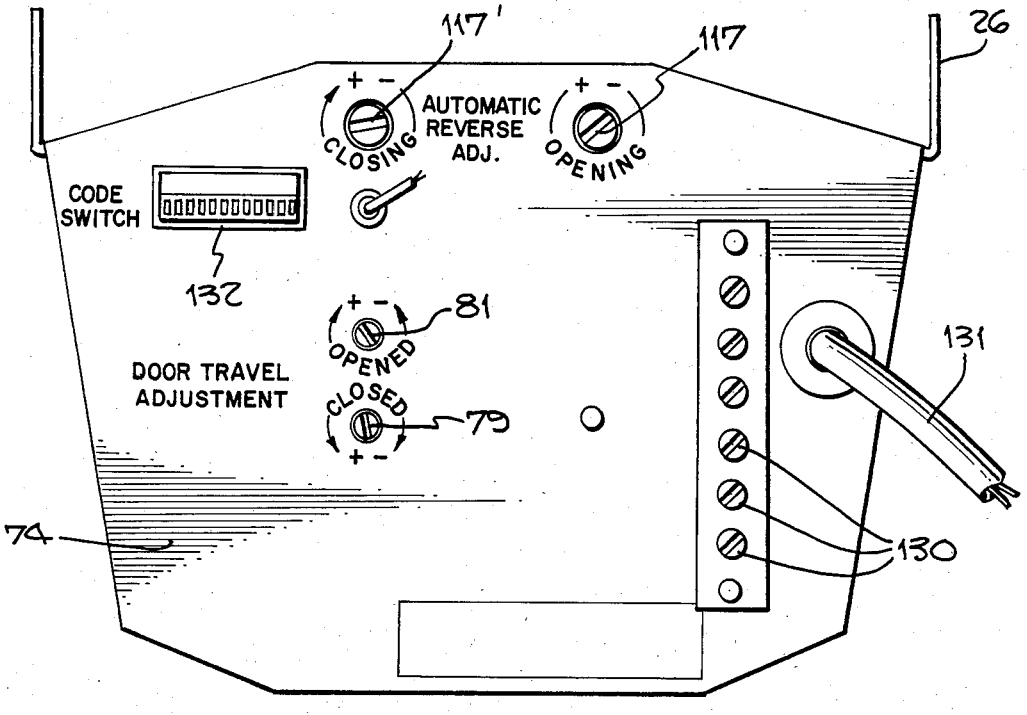
FIG. 16 is an elevational view of the display board on the line 16—16 of FIG. 3.
Figure 17:
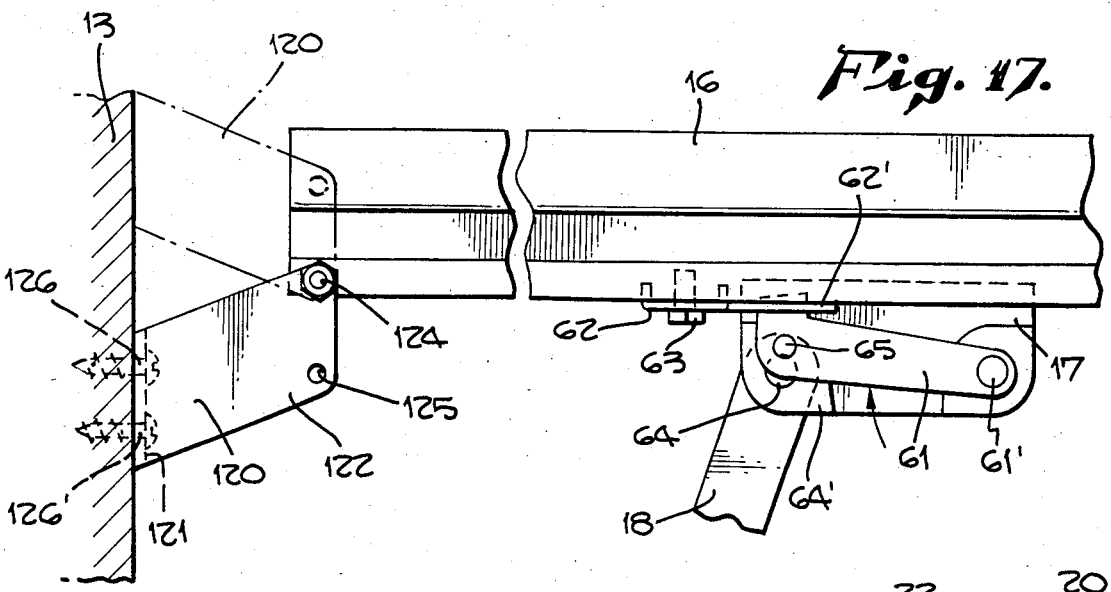
FIG. 17 is a fragmentary side elevational view of the end of the track adjacent the door showing details of the drive block and of the anchoring bracket.

FIGS. 14 and 15 are devoted to the manner in which the motor housing is adapted to a shift. When the panel or door engages an obstruction, the physical shifting and its relationship to the electronic circuit will be treated as an individual feature, FIGS. 14 and 15, the tension adjustment for the obstruction release also being individually treated, FIG. 8. The abundance of sheet metal stampings and structural parts have been worked into a single composite frame with appropriate supports mounting the components and adjusting expedients in exposed position. Such features will be handled as an individual attribute of the mechanism.

Figure 1:
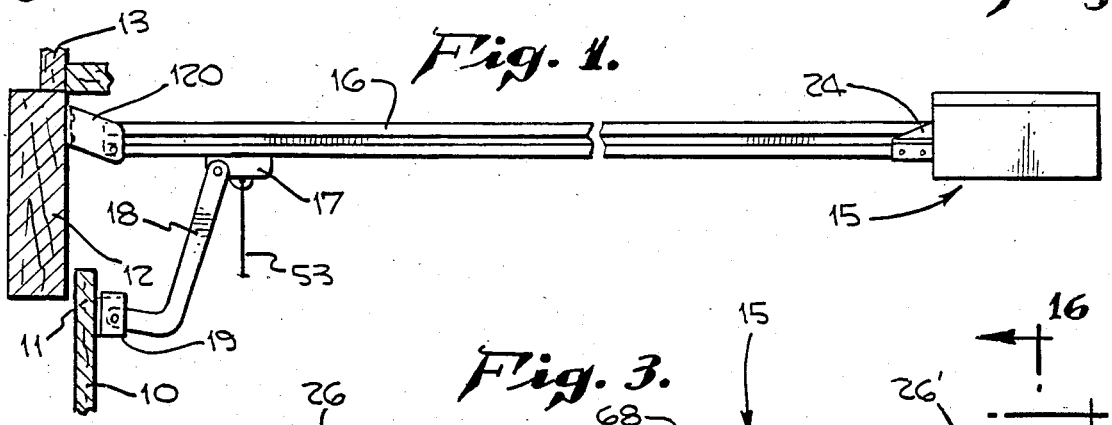
FIG. 1 is a side elevational view of the mechanism in position for opening and closing a conventional door.

As depicted in FIG. 1, there is a panel in the form of a garage door 10 shown in closed position with its upper end 11 in engagement with a header 12, serving as part of a door frame 13.

A mechanism for manipulating the door 10 is contained as a unit within a housing 15, the housing 15 being secured in a manner, not shown, to the building structure at a location more or less on a level with the location of the header 12. Extending from the housing 15 is a track 16, the track being slightly longer than the anticipated range of travel of a panel drive block 17, which is adapted to be drawn from one end to the other of the track 16. The drive block 17 is connected to the upper end 11 of the door 10 by means of an appropriate conventional arm 18 which is advantageously pivotally connected at one end to a bracket 19 on the door and pivotally connected at the other end to the panel drive block 17.

The housing 15, in addition to containing the appropriate mechanism for moving the door between closed and open positions also contains a radio receiving circuit which, when activated by a conventional hand-held radio transmitter, sets the mechanism in operation whereby to pull the panel drive block 17 from the left end of the track 16, as shown in FIG. 1, to a position adjacent the right-hand end, this action being one which, acting through the arm 18, pulls the door 10 from the closed position of FIG. 1 to a full open position.

A second impulse given to the radio receiver in the housing 15 by, for example, the same hand-held transmitter, causes a reverse action of the mechanism in the housing 15, pushing the panel drive block 17 from the right-hand end of the track 16 to the left-hand end of the track, thereby to push the door 10 progressively into the closed position which is shown in FIG. 1. The operation just described is conventional for devices of this general character.

Figure 2:
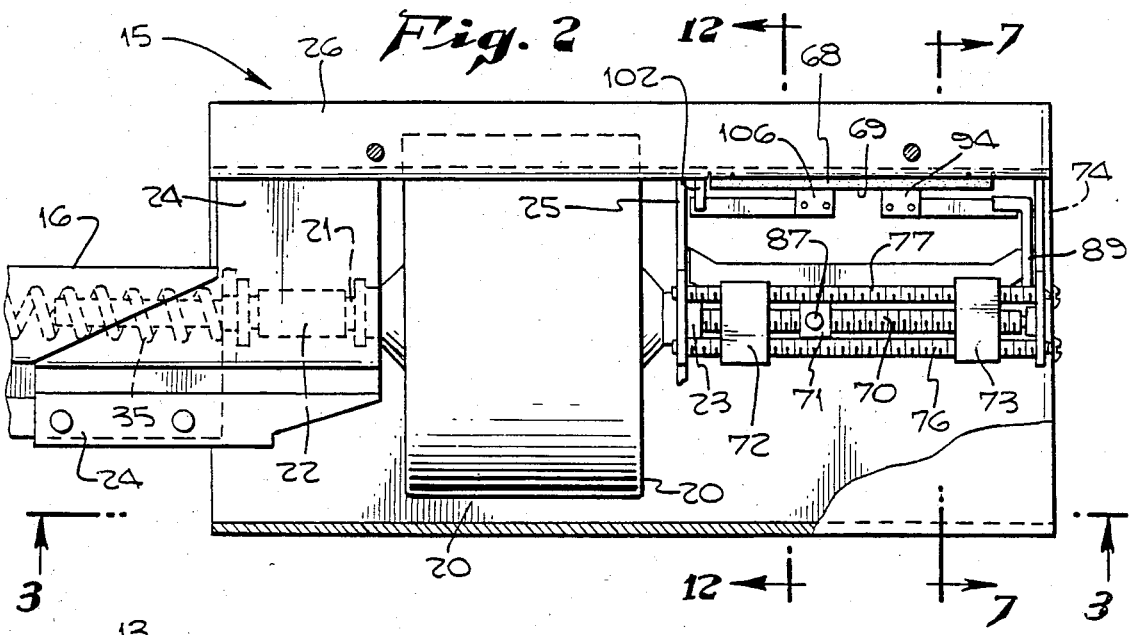
FIG. 2 is a side elevational view of the operating mechanism with the cover substantially broken away on the line 2—2 of FIG. 3.
Figure 3:
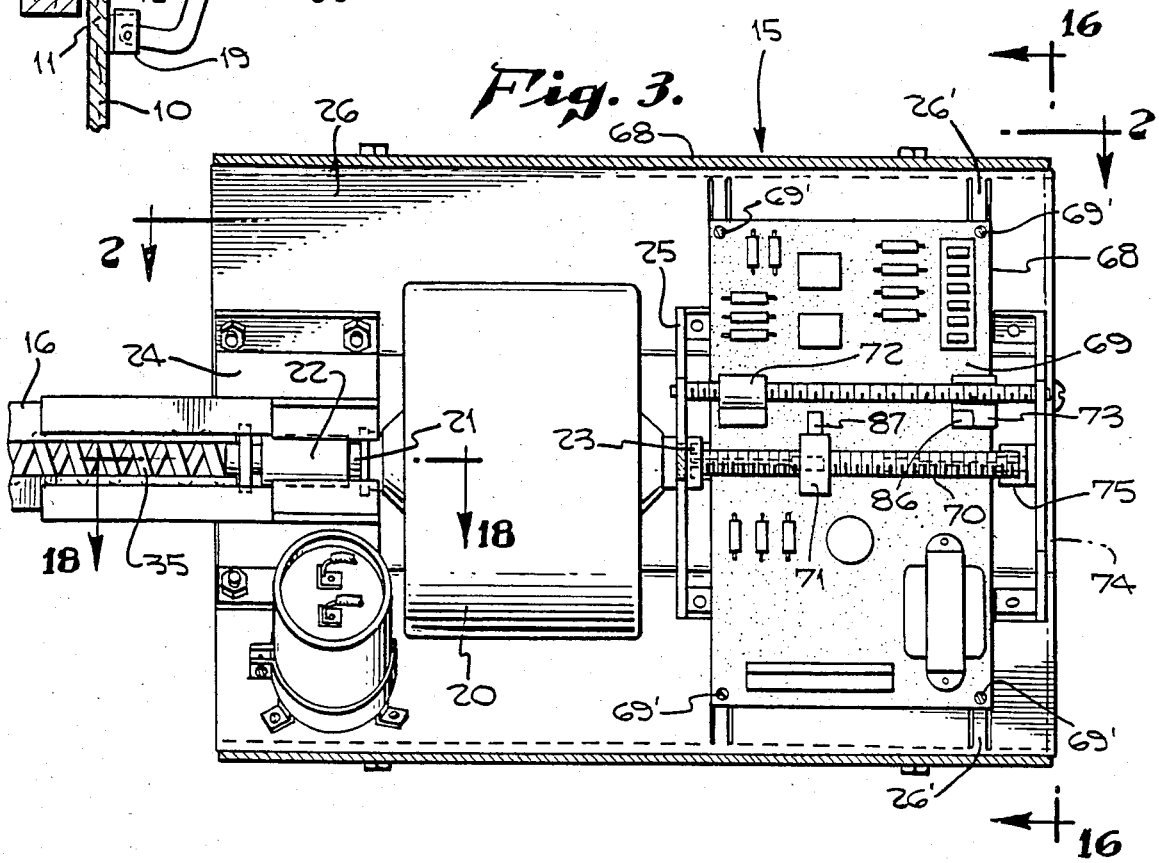
FIG. 3 is a bottom plan view of the operating mechanism with the cover removed.

As shown in FIGS. 2 and 3, the motivating force for shifting the door 10 from one position to another is an electric motor 20. Extending from the left-hand side of the motor 20, as viewed in FIG. 2 and 3, is a conventional drive shaft 21 and coupling assembly. At the opposite or right-hand end of the drive shaft 21 is another coupling 23, contained within a conventional bushing, not shown. A sheet metal stamping 24, serving as a motor mount, supports the motor at the left end, as viewed in FIGS. 2 and 3. A similar appropriate motor mount 25 supports the right-hand end of the motor 20, both motor mounts being in turn mounted upon a base plate 26, likewise consisting of a sheet metal stamping.

The bracket 24 serves in part as a mounting for the right-hand end of the track 16. For details of the track construction, reference is made to FIGS. 4, 5 and 6. The track 16 is also a sheet metal member bent and folded to provide an upper passage 27, a lower passage 28, and an interconnecting passage 29 joining the upper passage with the lower passage. The passages are in parallel relationship and extend throughout the full length of the track 16.

Coupled to the drive shaft 21 by use of the coupling assembly 22 is a drive screw 35 of special construction. The drive screw 35 is a single piece of rod wound to provide an open screw construction having multiple turns 36, 37, 38, etc., equally spaced throughout the entire length at a predetermined pitch distance. The spiral construction of the drive screw 35 also provides an open central passage 39. Extending around the drive screw 35 is a jacket 40, the jacket providing an axial bore 41 for snugly accommodating the drive screw 35. The jacket, being of synthetic plastic resin material having a low friction characteristic, serves as a self-lubricating retention bore for retention of the drive screw 35. Flat outside surfaces of the jacket 40 are contained within the upper passage 27, as shown in FIG. 5. A lateral opening 42 in the jacket, extending throughout its length, communicates with the interconnecting passage 29.

Figure 18:
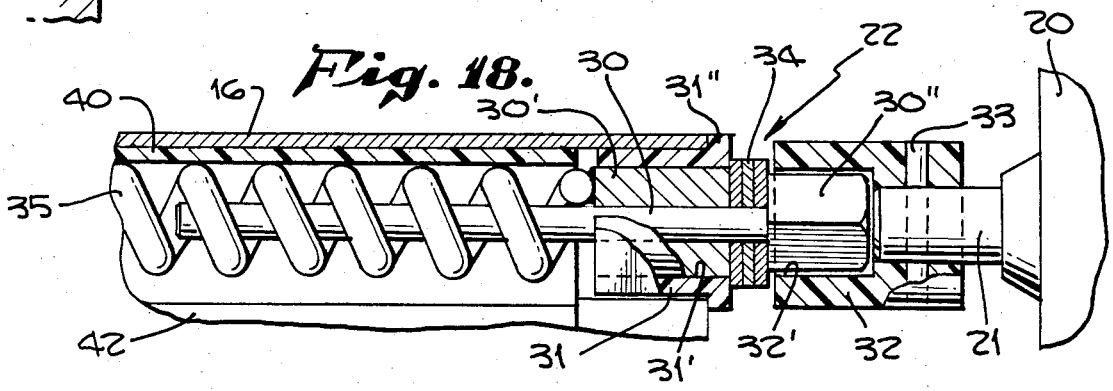
FIG. 18 is a fragmentary longitudinal sectional view on the line 18—18 of FIG. 3.

To improve the quietness of operation of the moving parts, as well as to make it possible to readily interchange tracks 16 of varied lengths or characteristics, the coupling assembly 22 may be a specially two part structure. As shown in FIG. 18, the end of the screw 16 adjacent the motor 20 is provided with a supporting assembly comprising a central shaft 30, a rotating section 30' which has a cylindrical exterior and an end section 30'' which has a square configuration.

For holding the section 30' there is a bushing 31 of synthetic plastic resin material having a cylindrical central bore 31' providing a low friction support for the screw. The exterior of the bushing has a square cross-sectional configuration to fit snugly within the end of the track 16. A bead 31'' prevents the bushing from being pushed into the track 1 beyond the outer end.

On the drive shaft 21 is a sleeve 32, likewise of synthetic plastic resin material. The sleeve is non-rotatably secured to the drive shaft by means of a lock pin 33. To accommodate the square section 30 of the coupling there is a square bore 32' within the sleeve 32 of a size such as to provide a drive fit. Washers 34 space the rotating sleeve 32 from the stationary track 16 and bushing 31. The snug fit of the section 30 within the square bore 32 prevents noise and chatter. Provision of a separable connection makes it possible to use a single power assembly in the housing 15 to accommodate track lengths of any size and the assortment of drive screws of varying lengths and pitches.

Of special consequence is a traveler 43, likewise of low-friction synthetic plastic resin material. The traveler 43 has a plurality of transversely extending holes 44 extending throughout its length through which pass the turns 36, 37, 38, etc., of the drive screw 35. As shown advantageously in FIG. 5, the traveler 43 extends from the axial bore 41 radially outwardly through the lateral opening 42 and inter-connecting passage 29 into the lower passage 28. When the drive screw 35 is rotated by motor action, the screw effect of the turns of the drive screw with respect to the traveler 43 moves the traveler in one direction or another, depending on the direction of rotation of the drive screw, from one end to the other of the track.

For a drive screw 35 of a selected pitch as exemplified in FIGS. 4 and 6, the traveler 43 is provided with six holes. The pitch may be selected so that, for a conventional motor speed, the rate of door travel will be acceptable, as for example in operating a single piece door where part only of the door is within the buidling in full open position. Where a more rapid rate of door travel may be desired, as for example for a multiple panel type door where the entire door is moved to a position within the building in full open position, a drive screw of the screw length but greater pitch may be employed. For such a screw the traveler may need no more than five holes.

By reason of employment of a coupling structure 22 which is readily disengageable and re-engageable, screws 35 of different pitch are readily interchangeable. Interchangeability is further advantageous where, on occasions, screws of different overall lengths may need to be used.

The panel drive block 17 previously described is adapted to be normally engaged with the traveler 43 for automatic operation, as shown in FIG. 4. For this purpose there is provided in the traveler 43 an appropriate downwardly open recess 45 for reception of a connecting arm 46 on the panel drive block. A torsion spring 47 having one arm 48, acting against a springkeeper recess 49 in the panel drive block, has its other arm 50 urged against a finger 51 on the connecting arm, thereby to extend the connecting arm 46 into the downwardly open recess 45. The connecting arm 46 is generally arcuate in shape and adapted to travel in a generally arcuate aperture 52 in the panel drive block 17.

For those occasions where there is need to manually disconnect the panel drive block 17 from a traveler 43, a pull rope 53 is used. By pulling preferably inwardly on the pull rope 53, which is fastened to the lower end of the connecting arm 46, the connecting arm can be disengaged from the recess 45. As the connecting arm is pulled arcuately downwardly against tension of the arm 50 of the torsion spring 47, the connecting arm is pulled to a position where a shoulder 54 of the connecting arm falls into engagement against a shoulder 55 on the panel drive block 17 into which position it is urged, again by action of the arm 50 of the torsion spring 47, as shown in FIG. 6. In this position the connecting arm is held out of engagement with the laterally open recess 45 and the garage door 10 can then be lifted and lowered by hand.

For reengagement all that is necessary is to pull the pull rope 53 in a direction downwardly sufficient to disengage the shoulders 54 and 55 from each other, whereupon action of the arm 50 of the torsion spring 47 again returns the connecting arm 46 into a position of engagement with the downwardly open recess 45. On opposite sides of the recess 45 are ramps 45' and 45'' to deflect the end of the connecting arm into the recess 45 as the traveler is moved in one direction or another, thereby to automatically reengage the drive panel block 17 with the traveler.

So that the control arm cannot be inadvertently pulled clear of the panel drive block 17 as the result of extra tugging on the pull rope, a shoulder 56 of the connecting arm 46 engages a counteracting shoulder 57 on the panel drive block, thereby blocking withdrawal of the connecting arm.

To improve the smoothness of travel of the panel drive block 17 along the track 16 and within the lower passage 28, outwardly projecting wings 60 and 60 on the panel drive block are provided with shoes 60' and 60' respectively of synthetic plastic resin material of low friction characteristics, and the shoes are guided in sliding relationship by the interior walls of the lower passage 28.

For independently latching the door in its closed position a latching hook 61 is provided carried by the panel drive block 17. An appropriate pivot 61' allows the free end of the hook 61 to swing into and out of engagement with a combined strike plate and catch 62 at a shoulder 62'. In order to have engagement of the hook 61 with the catch 62 at full closed position of the door the catch is provided with a bolt 63 for attachment to the track. By having the catch shiftable along the track it can be moved to a desired position of engagement and there bolted fast.

Of special consequence is the provision of a slot 64 in a flange 64' of the panel drive block 17 for reception of a pin 65 by which the hook is fastened to the arm 18. The slot 64 is long enough so that the hook is normally carried in a position to clear the catch 62 but is pushed upwardly in the slot 64 into latched position as the door comes to rest in its full closed position.

Conversely, when door opening action is initiated and the screw 35 exerts its pull upon the traveler 43 and consequently the drive block 17, the pin 65 is pulled downwardly in the slot 64 to a position where the hook 61 is released from engagement with the catch 62.

The radio receiver which receives the radio signal and translates it into operation of an electric motor 20 is embodied in a circuit board 68, shown in FIGS. 2 and 3, which presents a component supporting surface 69. The circuit board is preferably a single flat sheet, rectangular in shape, and fastened by appropriate screws 69' to respective brackets 26', cut and punched from base plate 26. It is of consequence that the circuit board 68 is mounted immediately adjacent the right side of the motor, as viewed in FIGS. 2 and 3, close to the base plate 26 on which the motor 20 is also supported.

For stopping travel of the door 10 at its full closed position, as shown in FIG. 1, and correspondingly at its full open position, previously described, there is provided a control screw 70 which is adapted to shift a cam follower 71 in a direction from right to left, and left to right, as viewed in FIGS. 2 and 3, whereby to engage in turn a closing cam member 72 and an opening cam member 73.

In the current embodiment of the invention the control screw 70 is attached by means of the coupling 23 to the drive shaft 21 of the electric motor 20. In this embodiment, when the electric motor operates, causing its drive shaft 21 to rotate, the drive screw 35 and control screw 70 rotate at the same number of revolutions per minute. In order, however, to make a compact arrangement of the controls, the pitch of turns of the control screw 70 is made a great deal smaller than the pitch of the turns 36, 37 and 38, etc., of the drive screw 35. By this arrangement, although the drive screw 35 may provide a range of travel for the panel drive block of something in the nature of seven feet, necessitating the length of the drive screw itself as being in excess of seven feet, the length of the control screw 70 may be kept to something of the order of from about three to five inches, this distance being dependent upon the pitch of turns of the drive screw 35. For purposes of stability there may be provided a display board 74 serving in part as a mounting flange on the base plate 26 equipped with a bearing 75 for the rotatable support of the right-hand end of the control screw 70, as viewed in FIGS. 2 and 3.

For mounting the closing cam member 72 and the opening cam member 73, there are provided a pair of spaced parallel cam adjusting screws 76 and 77. The cam adjusting screw 76 has its left end 78, as viewed in FIG. 13, rotatably supported in the motor mount 25. The right end, as viewed in FIG. 9, is rotatably supported in the display board 74. At the right end there is provided a screwdriver slot 79, being at an exposed location with respect to the frame and the general assembly. Similarly, the cam screw 77 at its left end 80 is rotatably supported in the motor mount 25, the right end being rotatably supported in the display board 74. A screwdriver slot 81 is provided in the right end of the cam screw 77 at a corresponding exposed location. The display board 74 accommodates the adjusting screws 76 and 77 so that the screwdriver slots are exposed and readily accessible.

By manipulation of the cam screw 76 making use of the screwdriver slot 79, and by reason of the fact that the cam screw is in threaded engagement with the closing cam member 72, the closing cam member can be moved toward the right or toward the left as the case may be, thereby to vary the location of an apex 82 of a cam track 83. Rotation of the cam screw 76 has no effect upon the position of the opening cam member 73 because of a clearance 84 in the opening cam member 73 through which the cam screw 76 passes.

In a similar fashion the opening cam member 73 can be shifted toward the right or toward the left by rotation of the cam screw 77 through its screwdriver slot 81, the cam screw 77 having a threaded engagement with the opening cam member 73. Shifting it toward the right or toward the left changes location of an apex 85 of a cam track 86.

When, for example, the electric motor 20 is rotated in a direction moving the panel drive block 17 in a direction from left to right, as viewed in FIG. 1, the cam follower 71 is at the same time moving in the same direction, but for a much shorter distance. When the door reaches full open position, the cam follower 71 and the cam projection 87 thereon engages the cam track 86 of the opening cam member 73, as viewed in FIG. 9, riding up the cam track until it passes over the apex 85. This action causes the cam follower 71, see FIGS. 7 and 10, to rotate in a clockwise direction about the control screw 70 from the position of FIG. 7 to the position of FIG. 10. Rotation as described results in the pressure of a driver 88 against a lever arm 89 causing the lever arm at its opposite end 90 to move against a leg 91 of a torsion spring 92 as the opposite end is displaced. The opposite end at the same time moves against an armature 93 of a switch component 94, shifting it from the position of FIG. 8 to the position of FIG. 11. It is the function of the switch component when subjected to this activity and acting through the electronic circuit to immediately stop operation of the electric motor and consequent movement of the panel drive block toward an open position, thereby establishing the full open position of the door 10.

When, upon an appropriate signal, as the motor 20 is reactivated, rotation will be in the opposite direction, causing the panel drive block to move in the opposite direction, namely, from right to left, as viewed in FIG. 1, the door closing direction. During this phase, rotation of the drive screw 35 is in the opposite direction as is also rotation of the control screw 70. Opposite rotation causes the cam follower 71 also to move in a direction from right to left until it engages the closing cam member 72, the cam projection 87 striking the cam face 83 so as to ride up the face to the apex 82. On this occasion action will be in the opposite direction from that of FIGS. 10 and 11, the result of which, by action of the switch component 94, will cause the electric motor 20 to stop operation, but in preparation for a rotation in the opposite direction when ultimately reenergized. Should the motor 20 not be stopped at precisely full closed position, or, on the contrary, full open position, the positioning can be precisely adjusted by manipulation of the cam screws 77 and 76, as the case may be, whereby to shift location of the apex of either the closing cam member, the opening cam member, or both, depending on what may be the need for adjustment.

In the event that the door 10 should strike an obstruction, either while it is moving toward an open position or moving toward a closed position, means is provided for stopping continued motion and reversing the direction of movement. The means made reference to relies upon the ability of the housing of the motor 20 to shift rotationally a limited distance in either clockwise or counterclockwise direction, the motor being mounted to permit such movement.

With the motor 20 mounted to permit rotational shift of the housing about the axis of the drive shaft, means is provided to limit the extent of the shift. For this purpose, a rod 100 is fastened to an end wall 20' of the electric motor 20, as shown in FIG. 8. The rod projects outwardly through a slot 101 in the motor mount 25. Rotational shift of the motor is limited by engagement of the rod 100 with one end or the other of the slot 101.

In order to make use of the motor shift to modify operation of the motor, as for example, causing it to reverse operation, there is provided a motion control arm 102 at the left end of a bracket 103, as viewed in FIG. 8. The rod 100, acting as a motion control actuator, extends through an opening 104 in the motion control arm 102. When the motor shifts in position as described, clockwise, as viewed in FIG. 14, for example, the motion control arm 102 shifts bodily in a corresponding direction against a switch arm 105 of a motion control component 106 in the electronic circuit, shifting it from the position of FIG. 8 to the position of FIG. 15. Displacement of the switch arm as described may be used by manipulation of the electronic circuit to either reverse direction of the motor or, if preferred, to stop operation of the motor.

In order to damp the rotational shift of the motor during movement, right or left, for the purpose described, the bracket 103 is provided with an adjustable mount on the frame. For this purpose there is a bridge 111 having two legs 110 and 110', see FIG. 8. A motion damping adjustment screw 112 extending through the panel 74 has a threaded engagement with one end of the bridge 111, and a coil spring 113 is confined between the bridge 111 and a flange 114 of the bracket 103 overlying the panel 74. Similarly there is provided a motion damping adjustment screw 115 and its coil spring 116 for the other end of the leg 111. Screwdriver notches 117, 117' for the screws are at exposed locations relative to the frame and on the same face of the panel 74 as are the screwdriver slots 79 and 81 to provide easy access for adjustment.

By manipulating either or both of the adjusting screws, tension may be applied to restrain or dampen a shift in movement of the rod 100 and consequently the motor in either or both directions. Moreover, the motion adjusting component 106, just as the switch component 94, are both mounted upon the same component supporting surface 69 of the circuit board 65 at readily accessible locations immediately adjacent the operating parts, as can be seen from an examination of FIG. 2. The legs 110 and 110' prevent overtightening of the respective springs 113 and 115.

Because the construction and location of the overhead horizontal portion of door frames may vary from building to building, a special convenience bracket 120 may be provided for anchoring the front end of the track 16 to the part 13 of the door frame.

The bracket 120 has a base 121 and legs 122, on opposite sides of the base obliquely disposed relative to the base. At the free-ends of the legs are holes 124, 125 adjacent respective corners. Bolt holes 126, 126' assist in fastening the base 121 to the door frame. For a relatively higher position the track 16 is bolted at the upper holes 124 of the legs. Bolting at lower holes 125 would provide a lower position. Further changes in height can be secured by inverting the position of the bracket as suggested by the broken lines.

To further enhance the convenience of the mechanism the display board 74 provides a mounting also for a series of binding posts 130 for virtually all of the connections of the electronic circuit. A power line 131 may also extend through the display board 74.

Although most of the components of the electronic circuitry are advantageously mounted on the circuit board 68, a code switch 132 such, for example, a 12 bit piano DIP switch, although mounted on the circuit board, is positioned as shown accessible through the face of the display board 74. As a consequence, for both installation and servicing, where as usual the mechanism is mounted at stepladder height, all connections and adjustment can be made from a single position of a stepladder.

While a particular embodiment of the present invention has been shown and described, it will be obvious to those skilled in the art that changes and modifications may be made without departing from the invention in its broader aspects, and therefore, the aim of its appended claims is to cover all such changes and modifications as fall within the true spirit and scope of the invention.

Having described the invention, what is claimed as new in support of Letters Patent is as follows:

1. A remote control panel moving mechanism for moving a panel between a first and a second of two established positions, said mechanism comprising a frame with motor supports thereon, an electric motor on said frame having a drive shaft, a track in operative alignment with said drive shaft, a drive means in driven relationship with said drive shaft, a traveler in sliding relationship with said track and in driven relationship with said drive means, and a panel drive block in longitudinally moving relationship with said track and having an engagement with said traveler, said panel drive block having a range of travel corresponding to the range of travel of said panel between said first and second positions, an electronic circuit support mounted on said frame, said electronic circuit support including an electronic circuit and respective components for effecting starting, stopping and reversing operation of said electric motor, said starting component being responsive to remote control and a control shaft having an actuator in driven relationship with said electric motor, motor control means on said frame responsive to motion of said control shaft at said first and second positions of the panel and adapted to effect stopping of operation of said electric motor at said first and second positions, and means for adjusting the relationship between said motor control means and said actuator, said motor control means comprising a cam track element and a cam follower element, one of said elements being located on the control shaft and the other of said elements being located on the frame, said elements being adjustable relative to each other for establishing the location of said first and second positions of the panel.

2. A remote control panel moving mechanism as in claim 1 wherein one of said elements of said motor control means has a rotationally fixed and axially shiftable location on the control shaft and the other of said elements has a rotationally fixed and axially shiftable location on the frame, said other of said elements having a manual adjustment relative to the frame for establishing the location of said first and second positions of the panel.

3. A remote control panel moving mechanism as in claim 1 wherein said circuit board comprises an exposed component supporting surface, said board being located adjacent the side of said electric motor opposite from said drive shaft and adjacent said control shaft, said cam means, said shiftable connection and said motion control actuator.

4. A remote control panel moving mechanism as in claim 1 wherein said track comprises an elongated sheet metal enclosure having laterally spaced parallel guide passages for accommodation of respectively said drive train and said panel drive block, there being an elongated interconnecting passage between said guide passages, and low friction shoe means on said panel drive block in sliding relationship with the respective guide passage.

5. A remote control panel moving mechanism as in claim 1 wherein said drive means comprises a rod in the form of a spiral having a multiple number of continuous turns with said turns being at uniform fixed distances from each other and providing a screw of fixed non-yieldable lengthwise dimension with an open central passage therethrough.

6. A remote control panel moving mechanism as in claim 5 wherein said track comprises an inner tubular jacket of synthetic plastic resin material surrounding said drive screw and an outer single wall tubular jacket surrounding said inner tubular jacket.

7. A remote control panel moving mechanism as in claim 1 wherein said track comprises an elongated sheet metal enclosure having laterally spaced parallel guide passages for accommodation respectively of said drive train and said panel drive block, there being an elongated interconnecting passage between said guide passages for accommodation of said traveler, said traveler having a laterally open recess therein, and a connecting arm on said panel drive block having a resiliently biased releasable engagement with said traveler at a location within said laterally open recess.

8. A remote control panel moving mechanism as in claim 7 wherein there are temporary mutually engageable detent elements on, respectively, said connecting arm and said panel drive block, whereby to detain said arm in release position from said traveler.

9. A remote control panel moving mechanism as in claim 8 wherein there is resilient means acting between said connecting arm and said panel drive block adapted to effect reengagement of said connecting arm and said traveler upon release of said mutually engageable detent elements from each other.

10. A remote control panel moving mechanism as in claim 1 wherein there is a shiftable connection between said motor and said frame whereby to provide a limited shift in position of said motor when movement of said drive means is restrained, a motion control component in said electronic circuit, and a motion control actuator on said motor in operative relationship with said motion control component whereby to effect a modification in operation of said motor.

11. A remote control panel moving mechanism as in claim 10 wherein said track comprises an elongated sheet metal enclosure having respective parallel passages for reception of said drive screw, said traveler and said panel drive block and there is a passageway through the sheet metal enclosure in longitudinal alignment with the axis of said drive shaft, a jacket in said passageway of low friction material having a central axial bore and a lateral opening in said jacket extending throughout the length of said passageway, said drive screw being located in said bore.

12. A remote control panel moving mechanism as in claim 10 wherein said track comprises an elongated sheet metal enclosure having respective parallel passages for reception of said drive screw, said traveler and said panel drive block and traveler has a plurality of transversely extending holes, said holes being spaced from each other at distances equal to the distances between adjacent turns of said screw, said drive screw having turns of fixed pitch extending through said holes.

13. A remote control panel moving mechanism as in claim 12 wherein said elongated sheet metal enclosure which has parallel guide passages for accommodation of respectively said drive screw and said panel drive block has an elongated interconnecting passage between said guide passages for slidable reception of said traveler, said panel drive block having an attachment to said traveler.

14. A remote control panel moving mechanism as in claim 10 wherein the shiftable connection comprises a circumferentially yieldable support for said motor on said frame, projecton means on said motor comprising a stop acting between said motor and said frame whereby to establish limits to shift in position of said motor in both forward and reverse directions, said motion control actuator being responsive to shift in position of said motor whereby to modify the operation of said motor in response to restraint of movement of said panel drive block.

15. A remote control panel moving mechanism as in claim 14 wherein there is a yieldable connection between said projection means and said frame whereby to damp movement of said projecton means in both forward and reverse directions.

16. A remote control panel moving mechanism as in claim 15 wherein each of said threaded connectors has a mutually adjustable end element at an exposed location relative to said frame.

17. A remote control panel moving mechanism for moving a panel between a first and a second of two established positions, said mechanism comprising a frame with motor supports thereon, an electric motor on said frame having a drive shaft, a track in operative alignment with said drive shaft, a drive means in driven relationship with said drive shaft, a traveler in sliding relationship with said track and in driven relationship with said drive means, and a panel drive block in longitudinally moving relationship with said track and having an engagement with said traveler, said panel drive block having a range of travel corresponding to the range of travel of said panel between said first and second positions, an electronic circuit support mounted on said frame, said electronic circuit support including an electronic circuit and respective components for effecting starting, stopping and reversing operation of said electric motor, said starting component being responsive to remote control and a control shaft having an actuator in driven relationship with said electric motor, motor control means on said frame responsive to motion of said control shaft at said first and second positions of the panel and adapted to effect stopping of operation of said electric motor at said first and second positions, said drive block including a retractable and resiliently extendable arm normally biased towards extended position, a releasable detent for holding said arm in retracted position, a laterally open recess in said traveler, an arcuate aperture in said drive block of upwardly progressively diminishing cross-sectional area adapted to receive a free end of said arm when in extended position, and obliquely disposed ramp means on said drive block adjacent said recess adapted to direct the free end of said arm into said recess upon movement of said traveler relative to said drive block.

18. A remote control panel moving mechanism for moving a panel between a first and a second of two established positions, said mechanism comprising a frame with motor supports thereon, an electric motor on said frame having a drive shaft, a track in operative alignment with said drive shaft, a drive means in driven relationship with said drive shaft, a traveler in sliding relationship with said track and in driven relationship with said drive means, and a panel drive block in longitudinally moving relationship with said track and having an engagement with said traveler, said panel drive block having a range of travel corresponding to the range of travel of said panel between said first and second positions, an electronic circuit support mounted on said frame, said electronic circuit support including an electronic circuit and respective components for effecting starting, stopping and reversing operation of said electric motor, said starting component being responsive to remote control and a control shaft having an actuator in driven relationship with said electric motor, motor control means on said frame responsive to motion of said control shaft at said first and second positions of the panel and adapted to effect stopping of operation of said electric motor, said motor control means comprising an adjustable cam means, said cam means comprising a cam follower responsive to operation of said control shaft and movable thereby along an axial path throughout a range of travel proportionate to the range of travel of said panel drive block, a first cam member having a cam track thereon at one end of said range of travel of said cam follower corresponding to one of said established positions and a second cam member having a cam track thereon at the other end of said range of travel of said cam follower, said cam follower having a displacement position in response to engagement of said cam follower with said cam tracks and a switch in said electronic circuit adapted to shift in position in response to action of said cam follower whereby to stop operation of said electric motor.

19. A remote control panel moving mechanisim as in claim 18 wherein there is a resilient return means acting between said cam follower and said frame whereby to return said cam follower to said neutral axial position after displacement by said cam track.

20. A remote control panel moving mechanism as in claim 18 wherein there is an adjustable cam mounting on said frame, said adjustable cam mounting comprising a pair of threaded adjusting screws, one of said screws having a threaded engagement with one of said cam members and the other screw having a threaded engagement with the other of said cam members for effecting an adjustable shift of position of said cam members whereby to vary said first and second established positions of said panel.

21. A remote control panel moving mechanism as in claim 20 wherein said cam follower has a pivotal support on said control shaft throughout the length of travel of said cam follower relative to said control shaft.

22. A remote control panel moving mechanism as in claim 20 wherein each adjusting screw has a sliding guiding relationship with respect to the other cam member, each said adjusting screw having a manually adjustable end element at an exposed location relative to said frame.

23. A remote control panel moving mechanism for moving a panel between a first and a second of two established positions, said mechanism comprising a frame with motor supports thereon, an electric motor on said frame having a drive shaft, a track in operative alignment with said drive shaft, a drive means in driven relationship with said drive shaft, a traveler in sliding relationship with said track and in driven relationship with said drive means, and a panel drive block in longitudinally moving relationship with said track and having an engagement with said traveler, said panel drive block having a range of travel corresponding to the range of travel of said panel between said first and second positions, an electronic circuit support mounted on said frame, said electronic circuit support including an electronic circuit and respsective components for effecting starting, stopping and reversing operation of said electric motor, said starting component being responsive to remote control and a control shaft having an actuator in driven relationship with said electric motor, motor control means on said frame responsive to motion of said control shaft at said first and second positions of the panel and adapted to effect stopping of operation of said electric motor at said first and second positions, a shiftable connection between said motor and said frame whereby to provide a limited shift in position of said motor when movement of said drive means is restrained, a motion control component in said electronic circuit, and a motion control actuator on said motor in operative relationship with said motion control component whereby to effect a modification in operation of said motor, the shiftable connection comprising a circumferentially yieldable support for said motor on said frame, projection means on said motor comprising a stop acting between said motor and said frame whereby to establish limits to shift in position of said motor in both forward and reverse directions, said motion control actuator being responsive to shift in position of said motor whereby to modify the operation of said motor in response to restraint of movement of said panel drive block, a yieldable connection between said projection means and said frame whereby to damp movement of said projection means in both forward and reverse directions, said yieldable connection comprising a free-standing bracket having an element in engagement with said projection means and a flange on said bracket comprising a bridge member adjacent the frame, said bridge member having a pair of laterally spaced legs, a threaded connector for each end of the bridge member acting between the respective end and an adjacent portion of the frame, and resilient means acting between each end and a corresponding portion of the flange whereby to enable adjustment of the restraining effect of said bracket on the shift in position of said motor relative to said frame.

24. A remote control panel moving mechanism for moving a panel between a first and a second of two established positions, said mechanism comprising a frame with motor supports thereon, an electric motor on said frame having a drive shaft, a track in operative alignment with said drive shaft, a drive means in driven relationship with said drive shaft, a traveler in sliding relationship with said track and in driven relationship with said drive means, and a panel drive block in longitudinally moving relationship with said track and having an engagement with said traveler, said panel drive block having a range of travel corresponding to the range of travel of said panel between said first and second positions, an electronic circuit support mounted on said frame, said electronic circuit support including an electronic circuit and respective components for effecting starting, stopping and reversing operation of said electric motor, said starting component being responsive to remote control and a control shaft having an actuator in driven relationship with said electric motor, motor control means on said frame responsive to motion of said control shaft at said first and second positions of the panel and adapted to effect stopping of operation of said electric motor, said motor control means comprising an adjustable cam means, said drive means comprising a screw, there being a releasable coupling assembly between said drive shaft and said screw, said coupling assembly comprising a sleeve on said drive shaft and a supporting shaft on said screw and a non-rotatable and axially separable connection between said sleeve and said supporting shaft, an end section of said supporting shaft having the separable connection with said sleeve and there is another section of said supporting shaft with a rotatable mounting in said track.

25. A remote control panel moving mechanism as in claim 24 wherein said rotatable mounting comprises a bushing of low friction character lodged in said track and a right cylindrical section of said supporting shaft in rotatable engagement with said bushing.

26. A remote control panel moving mechanism for moving a panel between a first and a second of two established positions, said mechanism comprising a frame with motor supports thereon, an electric motor on said frame having a drive shaft, a track in operative alignment with said drive shaft, a drive means in driven relationship with said drive shaft, a traveler in sliding relationship with said track and in driven relationship with said drive means, and a panel drive block in longitudinally moving relationship with said track and having an engagement with said traveler, said panel drive block having a range of travel corresponding to the range of travel of said panel between said first and second positions, an electronic circuit support mounted on said frame, said electronic circuit support including an electronic circuit and respective components for effecting starting, stopping and reversing operation of said electric motor, said starting component being responsive to remote control and a control shaft having an actuator in driven relationship with said electric motor, motor control means on said frame responsive to motion of said control shaft at said first and second positions of the panel and adapted to effect stopping of operation of said electric motor at said first and second positions, a catch means attached to said track comprising in part a laterally open recess in said traveler, a latching means carried by said drive block in operating relationship with said laterally open recess and an arm having one end for attachment to said panel and the other end having an attachment to said drive block, said other end having a motivating engagement with said latching means operable in closed position of said panel.

27. A remote control panel moving mechanism as in claim 26 wherein said catch means has an adjustable mounting on said track.

28. A remote control panel moving mechanism as in claim 26 wherein said latching means is shiftable to latching position in response to operation by said arm and is shiftable to unlatching position in response to panel opening movement of said drive block.

29. A remote control panel moving mechanism for moving a panel between a first and a second of two established positions, said mechanism comprising a frame with motor supports thereon, an electric motor on said frame having a drive shaft, a track in operative alignment with said drive shaft, a drive means in driven relationship with said drive shaft, a traveler in sliding relationship with said track and in driven relationship with said drive means, and a panel drive block in longitudinally moving relationship with said track and having an engagement with said traveler, said panel drive block having a range of travel corresponding to the range of travel of said panel between said first and second positions, an electronic circuit support mounted on said frame, said electronic circuit support including an electronic circuit and respective components for effecting starting, stopping and reversing operation of said electric motor, said starting component being responsive to remote control and a control shaft in driven relationship with said electric motor, motor control means on said frame responsive to motion of said control shaft at said established positions of the panel and adapted to effect stopping of operation of said electric motor, said motor control means being an adjustable cam means comprising a cam follower responsive to operation of said control shaft and movable thereby along an axial path throughout a range of travel proportionate to the range of travel of said panel drive block, a first cam member having a cam track thereon at one end of said range of travel of said cam follower corresponding to one of said established positions and a second cam member having a cam track thereon at the other end of said range of travel of said cam follower, said cam follower having a displacement position in response to engagement of said cam follower with said cam tracks and a switch in said electronic circuit adapted to shift in position in response to action of said cam follower whereby to stop operation of said electric motor, an adjustable cam mounting on said frame, said adjustable cam mounting comprising a pair of threaded adjusting screws, one of said screws having a threaded engagement with one of said cam members and the other screw having a threaded engagement with the other of said cam members for effecting an adjustable shift of position of said cam members whereby to vary said first and second established positions of said panel, a manually adjustable end element for each said adjustable screw, a circumferentially yieldable support for said motor on the frame, projection means on said motor comprising a stop acting between said motor and said frame whereby to establish limits to shift in position of said motor in both forward and reverse directions, said motion control actuator being responsive to shift in position of said motor whereby to modify the operation of said motor in response to restraint of movement of said drive block, said motion control actuator having a flange mounted adjacent a portion of said frame whereby to damp movement of the projection means in both forward and reverse directions, a yieldable connection between the projection means and the frame comprising a bridge having opposite end portions and a resilient adjusting connector between each respective end portion and a corresponding portion of the frame having a manually adjustable end element, and a display board at an exposed location relative to the frame having mounted thereon in juxtaposition said manually adjustable end elements of said connectors and said manually adjustable end elements of said adjustable screws.

30. A remote control panel moving mechanism as in claim 29 wherein said manually adjustable end elements comprise screw driver slots.

31. A remote control panel moving mechanism as in claim 29 wherein there is a series of electrical binding posts for the electronic circuit mounted in juxtaposition on said display board.

32. A remote control panel moving mechanism as in claim 29 wherein a code switch for the mechanism is mounted at a location adjacent to and visible through said display board adjacent said manually adjustable end elements.

33. A remote control panel moving mechanism for moving a panel between a first and a second of two established positions, said mechanism comprising a frame with motor supports thereon, an electric motor on said frame having a drive shaft and a casing for said motor, a track in operative alignment with said drive shaft, a drive means on one side of said motor casing in driven relationship with said drive shaft, a traveler in sliding relationship with said track and in driven relationship with said drive means, and a panel drive block in longitudinally moving relationship with said track and having an engagement with said traveler, said panel drive block having a range of travel corresponding to the range of travel of said panel between said first and second positions, a motor driven control shaft on a side of said casing remote from said drive means, an electronic circuit support mounted on said frame on said remote side, said electronic circuit support including an electronic circuit and respective components for effecting starting, stopping and reversing operation of said electric motor, said starting component being responsive to remote control, said control shaft being in driven relationship with said electric motor, motor control means on said frame responsive to motion of said control shaft at said established positions of the panel and adapted to effect stopping of operation of said electric motor, and a manual adjusting means for said control means, a shiftable connection between said motor and said frame on the remote side of said motor casing whereby to enable a limited shift in rotative position of said motor casing when movement of said drive means is restrained, a motion control component in said electronic circuit, a motion control actuator on said motor in operative relationship with said motion control component including a manual adjustment means whereby to effect a modification in operation of said motor in both rotational directions, and a display board on said remote side of said motor casing having an outwardly directed face, all said manual adjusting means being mounted on said outwardly directed face.

34. A remote control panel moving mechanism as in claim 33 wherein there is a code switch for said electronic circuit mounted in visible position relative to the outwardly directed face of said display board.

35. A remote control panel moving mechanism as in claim 33 wherein binding posts for said electronic circuit are mounted in visible accessible position on the outwardly directed face of said display board.

36. A remote control panel moving mechanism for moving a panel between a first and a second of two established positions, said mechanism comprising a frame with motor supports thereon, an electric motor on said frame having a drive shaft, a track in operative alignment with said drive shaft, a drive means in driven relationship with said drive shaft, a traveler in sliding relationship with said track and in driven relationship with said drive means, and a panel drive block in longitudinally moving relationship with said track and having an engagement with said traveler, said panel drive block having a range of travel corresponding to the range of travel of said panel between said first and second positions, said drive block including a retractable and resiliently extendable arm normally biased towards extended position, a releasable detent for holding said arm in retracted position, a recess in said drive block adapted to receive a free end of said arm when in extended position, and obliquely disposed ramp means on said traveler adjacent said recess adapted to direct the free end of said arm into said recess upon movement of said traveler relative to said drive block.

37. A remote control panel moving mechanism as in claim 36 wherein there is an aperture in said drive block of cross-sectional area progressively diminishing in a direction toward said drive block whereby to provide said ramp means.

* * * * *